US006069459A

United States Patent [19]

Koudijs

[11] Patent Number: 6,069,459

[45] Date of Patent: May 30, 2000

[54] PARTICLE ACCELERATOR WITH VACUUM PUMP CONNECTED TO THE LOW VOLTAGE SIDE

[75] Inventor: Reijer Koudijs, Kootwijkerbroek, Netherlands

[73] Assignee: High Voltage Engineering Europa B.V., Amersfoot, Netherlands

[21] Appl. No.: 08/937,723

[22] Filed: Sep. 25, 1997

[30] Foreign Application Priority Data

Sep. 25, 1996 [EP] European Pat. Off. ..... 96202677

[51] Int. Cl.[7] ..... H01J 23/00; H01J 23/34; H01J 25/00; H05H 9/00

[52] U.S. Cl. ..... 315/500; 313/237; 315/501; 315/505; 315/507

[58] Field of Search ..... 313/359.1, 360.1, 313/362.1, 237, 62; 315/500, 506–507, 501–505; 250/497.1, 288, 396, 398, 400

[56] References Cited

U.S. PATENT DOCUMENTS

| | | | |
|---|---|---|---|
| 4,032,810 | 6/1977 | Eastham et al. . | |
| 4,121,128 | 10/1978 | Roberts | 313/362.1 X |
| 4,721,918 | 1/1988 | Koudijs | 313/237 X |
| 5,034,718 | 7/1991 | Weisser et al. . | |
| 5,247,263 | 9/1993 | Purser . | |
| 5,789,875 | 8/1998 | Hiramoto et al. | 315/507 X |

FOREIGN PATENT DOCUMENTS

| | | |
|---|---|---|
| 299197 | 11/1993 | Japan . |
| 338179 | 12/1964 | U.S.S.R. . |

OTHER PUBLICATIONS

"A new 3 MV Tandem Pelletron System", Schroeder J.B. et al. Ninth International Conference on the Application of Accelerators in Research and Industry, Denton, Texas Nov. 10–12, 1986, vol. B24–B25, pt.2, Nuclear Instruments & methods in Physics Research, Section B, pp. 763–766.

"A Vacuum System for a 30 MV Tandem Van de Graaff", Halliday B.S., Proceedings of the 6th International Vacuum Congress, Kyoto, Japan, Mar. 25–29, 1974, vol. suppl. 2, pt.1, Japanese Journal of Applied Physics, 1974, Japan, pp. 195–198.

"A High Speed Gas Handling System for the Brookhaven National Laboratory Three Stage Tandem Van de Graaff Facility", Minati, K.F., IEEE Transactions on Nuclear Science, vol. ns–16, No. 3–1, Jun. 1969, New York, pp. 109–110.

*Primary Examiner*—Nimeshkumar D. Patel
*Assistant Examiner*—Mack Haynes
*Attorney, Agent, or Firm*—Jones, Day, Reavis & Pogue

[57] ABSTRACT

The disclosure relates to a particle accelerator which comprises two accelerating tubes as well as a charge-exchange channel, whereby the vacuum pump for evacuating from said charge-exchange channel gas particles injected therein is not connected to the high-voltage side but, via a vacuum tube, to the low-voltage side of the particle accelerator. This means a substantial simplification of the maintenance of the vacuum pump. In addition to that a motor and a generator are no longer required. By providing the vacuum pump with equipotential plates, which comprise pump holes arranged eccentrically round the center of the vacuum tube, the gas particles are in this configuration are accelerated while retaining the high breakdown strength.

12 Claims, 6 Drawing Sheets

PARTICLE ACCELERATOR WITH VACUUM PUMP CONNECTED TO THE LOW VOLTAGE SIDE

BACKGROUND OF THE INVENTION

The present invention relates to a particle accelerator comprising at least two accelerating tubes having a high-voltage side and a low-voltage side, with a channel comprising provisions for the injection of a gas therein being provided between the high-voltage sides of said accelerating tubes, and at least one vacuum pump connected to said channel.

A particle accelerator of this type is generally known. In particular a particle accelerator is known wherein a gas is injected into the charge-exchange channel (=CEC), which gas is pumped from the CEC by the vacuum pump after having interacted with a beam consisting of one or more types of charged or neutral particles. Said gas must be prevented from finding its way into the accelerating tubes as much as possible, because this leads to undesirable charge-exchange processes in said accelerating tubes, resulting in a reduced output and quality of the particle accelerator. The vacuum pump is supplied with the necessary power by a generator, for example, which is coupled with a motor via a driving mechanism, which for example comprises an electrically insulating driving shaft or driving belt. Said insulating driving mechanism electrically separates the vacuum pump and the generator present in the terminal, which are on high voltage, from a motor on a much lower voltage, namely on earth potential.

The drawback of the known particle accelerator is that the pump present in the terminal lacks in accessibility. Frequently the encasing housing the terminal and the accelerating tubes, which is usually made of metal, must be opened in order to carry out maintenance work, and the necessary electric screening facilities must be dismounted, and be mounted again after said maintenance work on the vacuum pump has been completed. This makes the required regular maintenance work on the vacuum pump(s) time-consuming and costly and, moreover, reduces the effective output of the known particle accelerator.

Another drawback of the known particle accelerator is the fact that a generator and a motor as well as an insulated driving mechanism mounted therebetween are required to provide the necessary electric power for the vacuum pump. Said parts require maintenance at an awkward place, and they are vulnerable to high-voltage breakdowns, which inevitably occur in particle accelerators of this type.

BRIEF SUMMARY OF THE INVENTION

The object of the present invention is to provide a particle accelerator which is reliable and which is simple to maintain.

In order to accomplish that objective the particle accelerator according to the invention is characterized in that said particle accelerator includes a vacuum tube connected to said channel, which is at least partially connected between said high-voltage side and said low-voltage side, and in that said vacuum pump is connected to said vacuum tube at the low-voltage side.

The advantage of the particle accelerator according to the invention is that the vacuum pump is on earth potential, thus making maintenance simpler, quicker and less costly. In addition to that the driving mechanism consisting of insulating material and the generator and the motor are no longer required. Furthermore the vulnerability due to high voltage breakdowns of the vacuum pump, which was previously on high-voltage, but which is on earth potential now, has been reduced, resulting in an enhanced reliability of the particle accelerator according to the invention.

Another advantage is moreover the fact that a greater freedom of choice is obtained with regard to the dimensions and the type of vacuum pump to be used, because usually more space is available for such an externally mounted pump.

One embodiment of the particle accelerator is according to the invention characterized in that it comprises a valve connected between the low-voltage side of said vacuum tube and said vacuum pump.

The advantage of this embodiment of the particle accelerator according to the invention is the fact that the valve, which is on earth potential, is closed prior to maintenance work being carried out on the vacuum pump, as a result of which it is not necessary to open the accelerating tube and the vacuum tube, which leads to a further saving on maintenance time with regard to the vacuum pump.

The present invention and its concomitant further advantages will be discussed in more detail hereafter with reference to the drawing, wherein like parts are numbered alike in the various Figures.

DETAILED DESCRIPTION OF THE INVENTION

Figure 1:
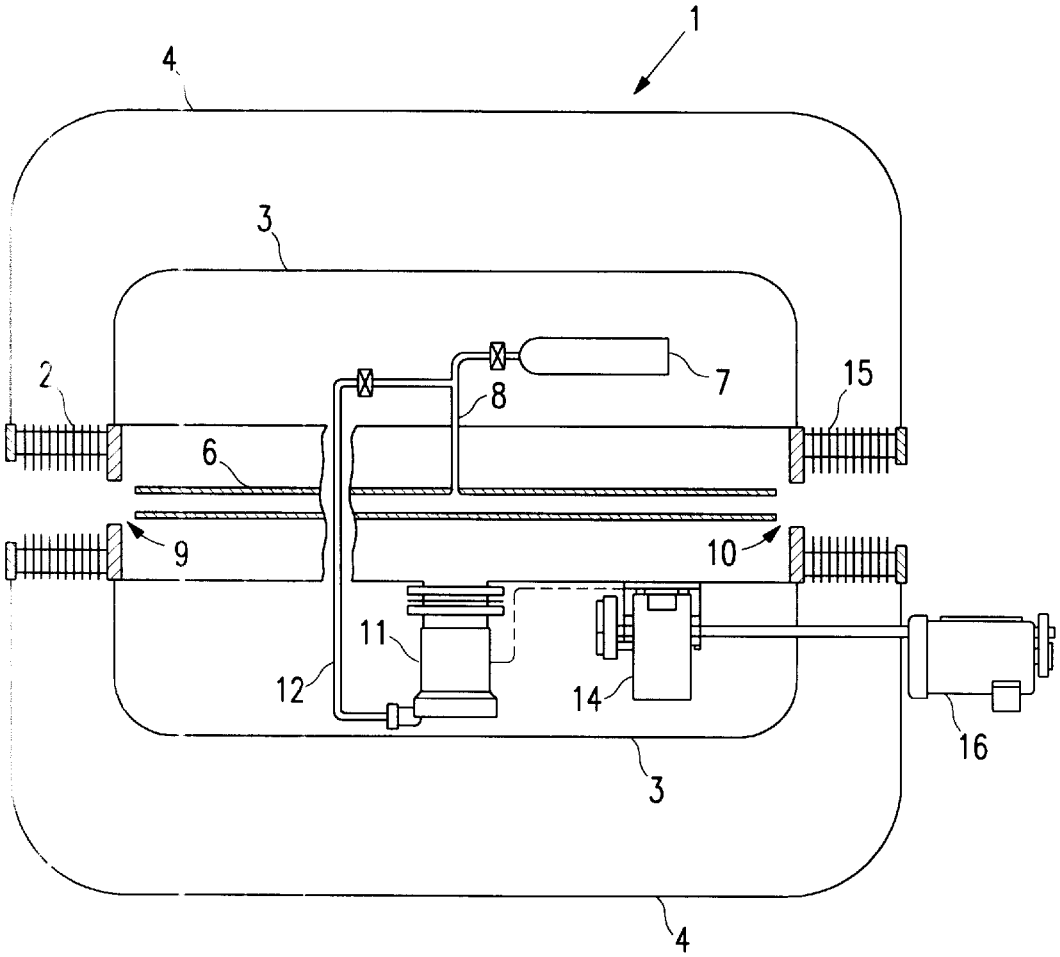
FIG. 1 PRIOR ART
FIG. 1 shows an embodiment of a known particle accelerator.
Figure 2:
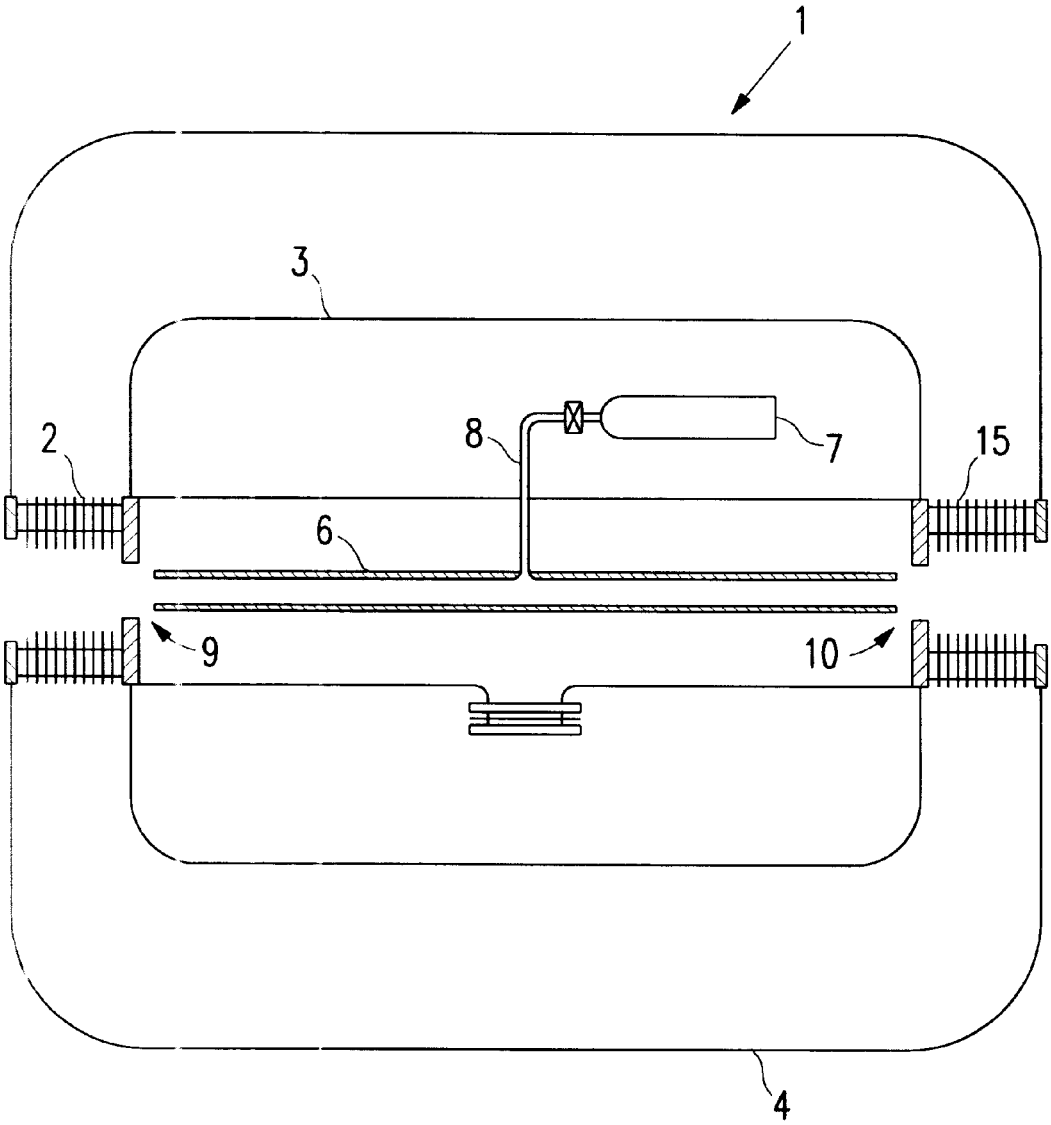
FIG. 2 PRIOR ART
FIG. 2 shows another embodiment of a known particle accelerator.
Figure 3:
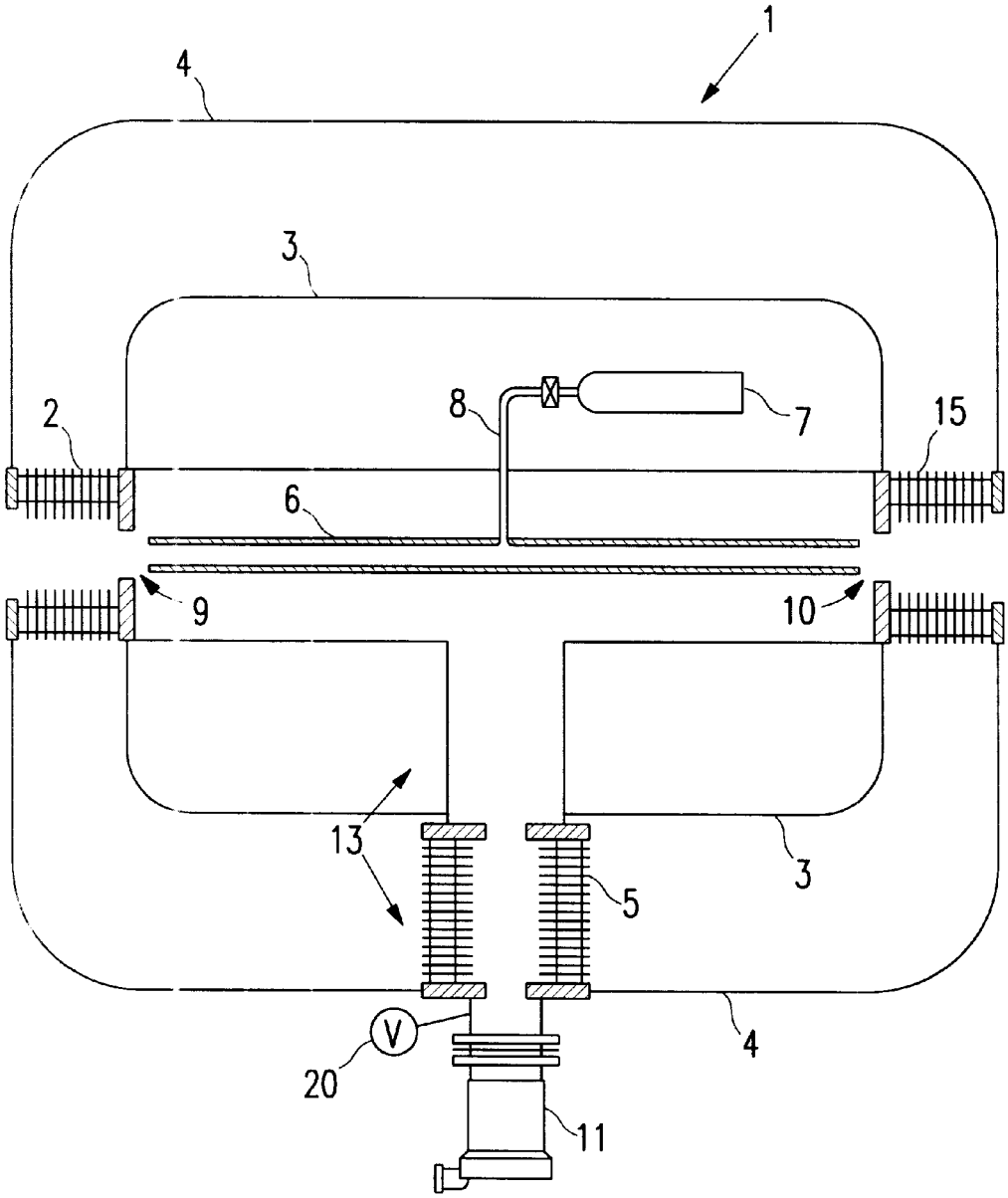
FIG. 3 shows an embodiment of the particle accelerator according to the invention.

FIGS. 1, 2 and 3 show a relevant part of a particle accelerator 1, in which electrically charged or neutral particles are accelerated/transported in at least one accelerator tube 2 by an emission source (not shown). To that end accelerating tube 2 is with its high-voltage side connected to terminal 3 and with its low-voltage side to the, usually metal, encasing 4, which is on earth potential. In a similar manner second accelerating tube 15 is connected between terminal 3 and encasing 4. Accelerating tubes 2 and 15 are provided with electrodes (not shown) known per se, which are separated from each other by insulators, and which are surrounded by corona rings. Furthermore an accelerating tube of this type comprises spark apertures, equipotential sections, if desired, and a resistor network in order to realize a substantially uniform voltage grading over accelerating tubes 2 and 15.

Particle accelerator 1 may be a tandem accelerator, for example, in which the high voltage difference is used for accelerating charged particles coming from an emission source in the direction of or from the terminal being on high voltage in accelerating tubes 2 and 15. In accelerating tube portions 2 and 15, in which a vacuum is generated by means of one or more vacuum or high-vacuum diffusion pumps, absorption pumps or cryogenic pumps, charge exchange processes occur in a CEC 6, which is positioned in terminal 3, the CEC 6 having openings 9 and 10 near the high-voltage of the accelerator tubes 2 and 15, which charge exchange processes are necessary in order to ensure the desired exit velocity. Furthermore particle accelerator 1 may be of a type in which neutral particles are transported from the earth potential to terminal 3 and wherein said particles are ionized in the CEC 6, followed by an acceleration of said ions in the second accelerating tube 15, in order to give them the desired exit velocity. In order to maintain this charge exchange process, which is desirable in the CEC 6, a gas is introduced into CEC 6 from a gas cylinder 7, via a supply pipe 8, which gas interacts with the beam of electrically charged or neutral particles moving through the CEC 6. This region of increased gas pressure within the CEC 6 must be maintained locally in CEC 6 as best as possible, because gas flowing into the accelerating tubes 2 and 15 would lead to undesirable charge exchange processes. The gas introduced into the CEC 6 flows to a vacuum pump 11 present in terminal 3, which is on high voltage, via the two ends 9 and 10. The evacuated gas can be recirculated via a return pipe 12, if desired. Said recirculating is optional, however.

The electric power required for vacuum pump 11 is generated by generator 14, which is in turn driven by a motor 16 being on earth potential. The required mechanical coupling between generator 14 and motor 16 may be a driving shaft or a driving belt, for example, which is electrically insulating in order to maintain the voltage difference between motor 16 and generator 14.

FIG. 2 shows another embodiment of a known particle accelerator, which does not comprise the vacuum pump 11, the generator 14 or the motor 16. The drawback of this embodiment is the fact that the gas injected into the charge-exchange channel 6 must be completely evacuated through accelerating tubes 2 and 15, resulting in a stronger increase of the pressure in said tubes, as a result of which more charge-exchange processes take place in said tubes.

FIG. 3 shows an embodiment wherein a vacuum tube 13 is connected between terminal 3 and encasing 4, which is generally made of metal, whereby the vacuum pump 11 on encasing 4 is connected to vacuum tube 13. Such a vacuum tube is provided with means similar to the means described above with reference to accelerating tubes 2 and 15. In this embodiment the vacuum pump is on earth potential, however, as a result of which maintenance of said vacuum pump is much simpler, because it is directly accessible. By mounting a valve 20 in vacuum tube 13, the maintenance work on the part of particle accelerator 1 positioned before said valve may even take place without the vacuum in accelerating tubes 2 and 15 and vacuum tube 13 being broken.

Figure 4:
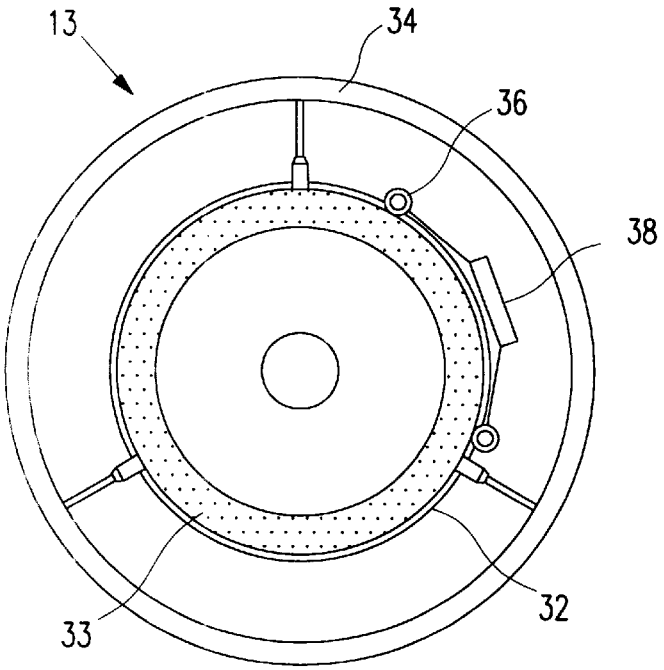
FIG. 4 shows a sectional view of a vacuum tube shown in FIG. 3 illustrating a resistor network, a corona ring and spark apertures.
Figure 5:
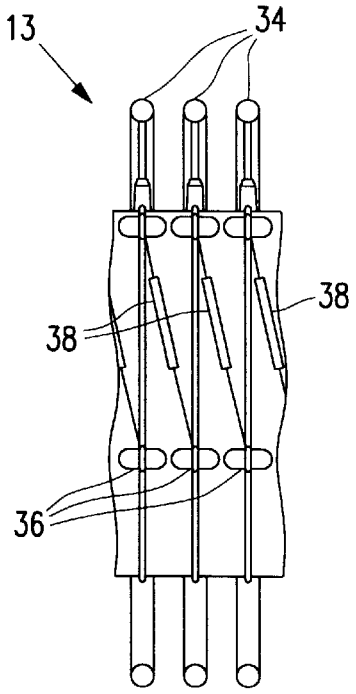
FIG. 5 shows a partial side elevational view of the vacuum tube shown in FIG. 4.

FIGS. 4 and 5 show the vacuum tube 13 with electrodes 32, insulator 33 and a corona ring 34. Spark gaps 36 are provided as is a network of resistors 38.

Figure 6:
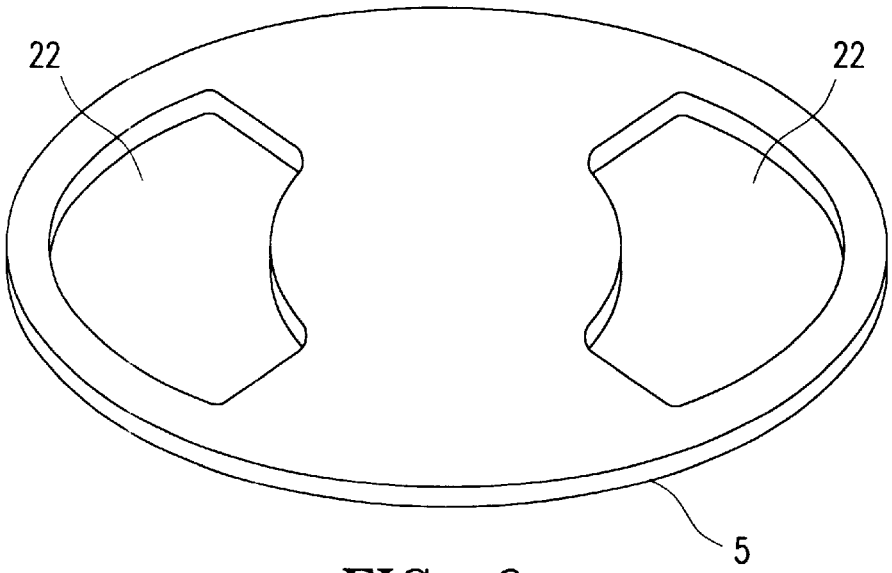
FIG. 6 shows pump holes aligned off center on an equipotential plate.
Figure 7:
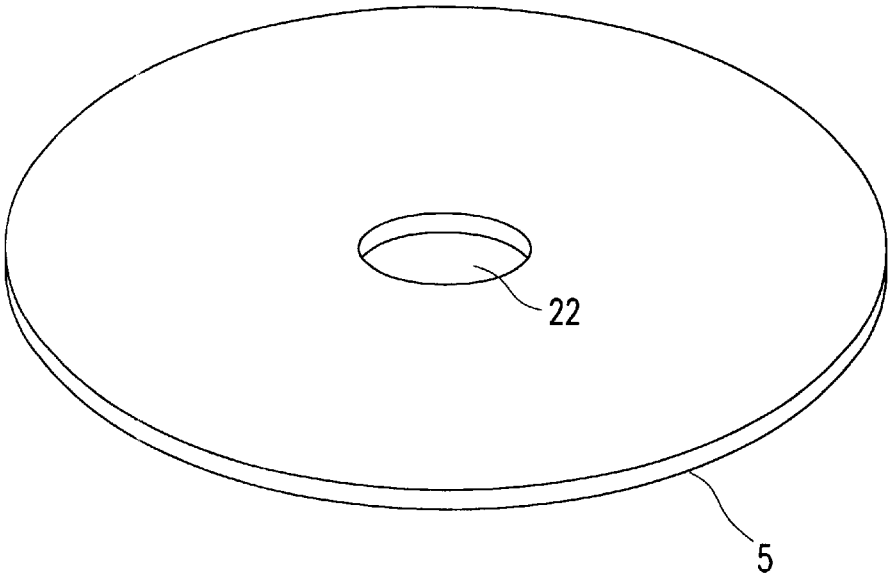
FIG. 7 shows a hole aligned along the central axis of an equipotential plate.
Figure 8:
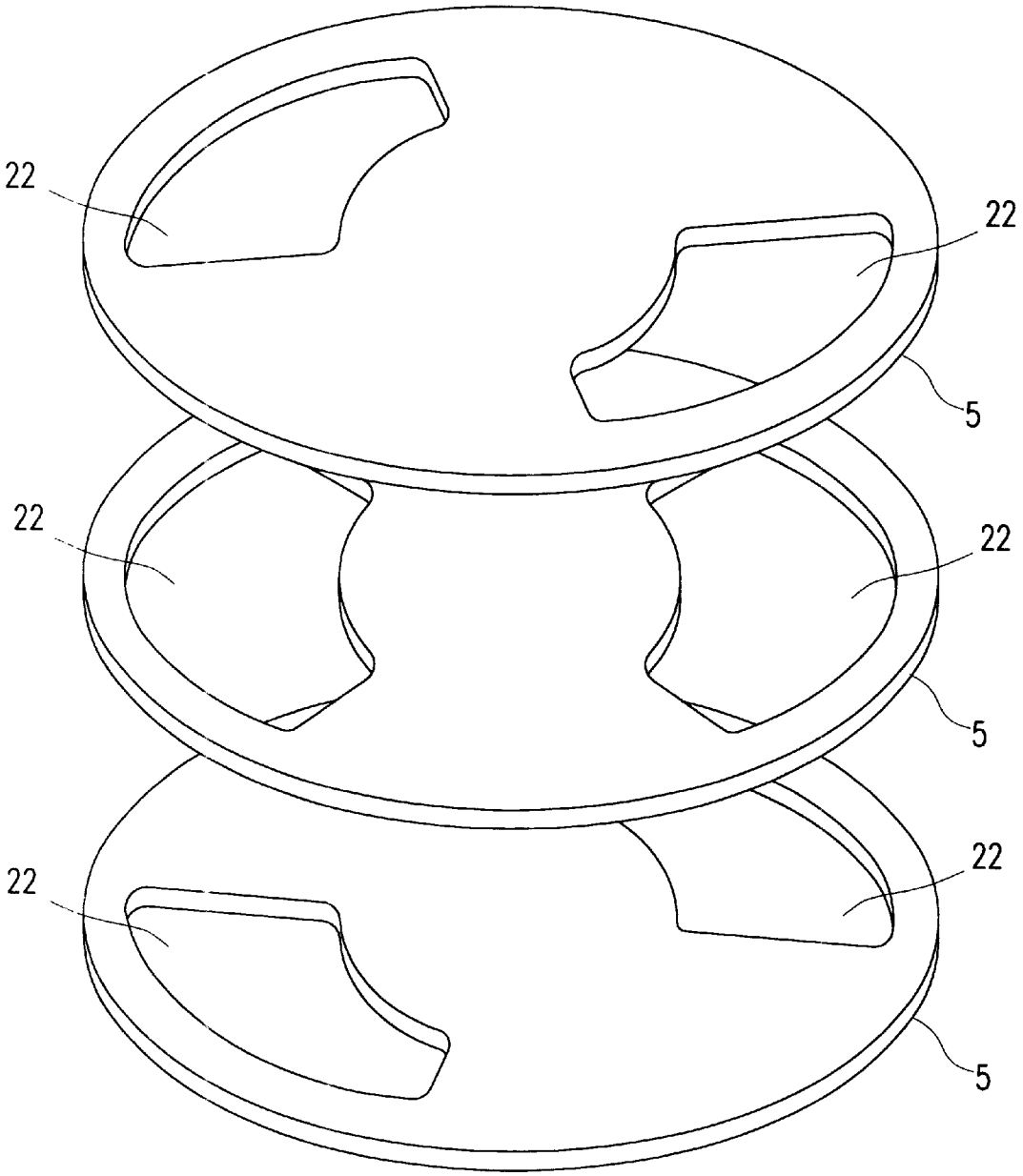
FIG. 8 shows pump holes aligned spiral-wise.

Positioned within vacuum tube 13 are equipotential plates 5, which are provided with a plurality of pump holes 22, FIG. 6, which function to enable the discharge of the gas to vacuum pump 11. In practice it has appeared to be advantageous to provide the pump holes off the centre of the vacuum tube as shown in FIG. 6. As a result the charged particles, which are inevitably present within such an accelerating tube and which are accelerated through the electric field in a direction perpendicularly to the equipotential surfaces, strike against an equipotential surface before reaching a high velocity. This results in a high breakdown strength of the tube, and the undesirable yet inevitable production of radiation is reduced. The pump holes may be arranged in a straight line as shown in FIG. 7, along the central axis of the equipotential plates, or the pump holes may be arranged spiral-wise as shown in FIG. 8.

I claim:

1. A particle accelerator comprising:

at least two accelerating tubes, each having a high-voltage side and a low-voltage side;

a charge-exchange channel having openings near said high-voltage sides of said at least two accelerator tubes;

means for the injection of a gas into said channel between said high-voltage sides of said at least two accelerating tubes;

at least one vacuum pump and open connection with said channel; and a vacuum tube in open connection with said channel, said vacuum tube being at least partially connected between said high-voltage side and said low-voltage side, and wherein said vacuum pump is connected to said vacuum tube at said low-voltage side.

2. A particle accelerator according to claim 1, including a valve connected between the low-voltage side of said vacuum tube and said vacuum pump.

3. A particle accelerator according to claim 1, wherein said vacuum tube includes means for achieving a more uniform potential gradient from said high-voltage side to said vacuum pump connected to the low-voltage side.

4. A particle accelerator according to claim 3, wherein said means for achieving the uniform potential gradient comprise a resistor network.

5. A particle accelerator according to claim 1, wherein said vacuum tube is provided with corona rings.

6. A particle accelerator according to claim 5, wherein said corona rings and/or said vacuum tube are provided with insulators and/or spark apertures.

7. A particle accelerator according to claim 1, wherein said vacuum tube is provided with equipotential plates.

8. A particle accelerator according to claim 7, wherein said equipotential plates are provided with pump holes.

9. A particle accelerator according to claim 8, wherein the centres of said pump holes lie on a straight line.

10. A particle accelerator according to claim 9, wherein said pump holes lie on the central axis of said equipotential plates, and each of said plates has a circular section.

11. A particle accelerator according to claim 8, wherein said pump holes lie off the centre of said equipotential plates.

12. A particle accelerator according to claim 11, wherein said pump holes are arranged spiral-wise round the centre of said vacuum tube.

* * * * *